US010369801B2

(12) United States Patent
Korthuis et al.

(10) Patent No.: US 10,369,801 B2
(45) Date of Patent: Aug. 6, 2019

(54) LIQUID PROPELLING COMPONENT

(71) Applicant: HEWLETT-PACKARD DEVELOPMENT COMPANY, L.P., Houston, TX (US)

(72) Inventors: Vincent C Korthuis, Corvallis, OR (US); David Maxfield, Philomath, OR (US); Andrew Queisser, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/522,340

(22) PCT Filed: Nov. 25, 2014

(86) PCT No.: PCT/US2014/067359

§ 371 (c)(1),
(2) Date: Apr. 27, 2017

(87) PCT Pub. No.: WO2016/085471

PCT Pub. Date: Jun. 2, 2016

(65) Prior Publication Data

US 2017/0326884 A1 Nov. 16, 2017

(51) Int. Cl.
*B41J 2/175* (2006.01)

(52) U.S. Cl.
CPC ..... *B41J 2/17543* (2013.01); *B41J 2/17546* (2013.01); *B41J 2/17566* (2013.01); *B41J 2002/17579* (2013.01)

(58) Field of Classification Search
None
See application file for complete search history.

(56) References Cited

U.S. PATENT DOCUMENTS

| | | | | |
|---|---|---|---|---|
| 4,516,134 | A | 5/1985 | Tamai | |
| 5,033,887 | A | 7/1991 | Baeuerle | |
| 5,821,951 | A * | 10/1998 | Fujii | B41J 2/04541 347/10 |
| 6,113,213 | A * | 9/2000 | Hosaka | B41J 25/34 347/20 |
| 6,375,627 | B1 * | 4/2002 | Mauze | A61B 5/14532 600/309 |
| 7,364,263 | B2 | 4/2008 | Silverbrook | |
| 8,539,812 | B2 | 9/2013 | Stringham et al. | |

(Continued)

FOREIGN PATENT DOCUMENTS

| | | |
|---|---|---|
| CN | 1485210 | 3/2004 |
| DE | 3218781 | 12/1982 |

(Continued)

*Primary Examiner* — Matthew Luu
*Assistant Examiner* — Tracey M McMillion
(74) *Attorney, Agent, or Firm* — HP Inc. Patent Department

(57) ABSTRACT

A liquid propelling component includes a liquid channel, a circuit block. The circuit block includes a first conductor disposed in the liquid channel to be in contact with liquid in the channel and a second conductor insulated from liquid in the channel. The liquid propelling component further includes a memory storing a digital code that corresponds to an analog value of the second conductor under a predefined charge.

19 Claims, 5 Drawing Sheets

(56) References Cited

U.S. PATENT DOCUMENTS

| | | | | |
|---|---|---|---|---|
| 2004/0239712 | A1 | 12/2004 | Liao et al. | |
| 2006/0098993 | A1 | 5/2006 | Yang | |
| 2007/0000838 | A1* | 1/2007 | Shih | G01N 30/466 210/656 |
| 2014/0190830 | A1* | 7/2014 | Sturmer | B01L 3/502792 204/452 |

FOREIGN PATENT DOCUMENTS

| | | |
|---|---|---|
| JP | 5571577 | 5/1980 |
| KR | 100670553 | 1/2007 |
| WO | WO-2013/158099 | 10/2013 |

* cited by examiner

LIQUID PROPELLING COMPONENT

BACKGROUND

Liquid propelling components include printheads for two- and three-dimensional printing, integrated printhead cartridges, digital titration devices/cartridges and lab-on-chips. Such liquid propelling components are able to propel, and in many instances, eject, liquid at relatively high precision in application areas including 2D and 3D printing, forensic labs, healthcare and life sciences. Depending on the field of application, high precision liquid propelling components can facilitate high resolution printed images, accurately reproduce predefined drop weights or drop positions and/or perform high precision diagnoses, to name just a few. In certain examples, the liquid propelling components are replaceable components that in order to operate need to be connected to a host device. The liquid propelling components are replaced by new ones after reaching a certain usage level, for example after exhaustion or after a one-time usage.

A host device or user needs to be able to verify if the liquid propelling component is supplied or manufactured by a trusted party. A trusted party can be an OEM (original equipment manufacturer) of the host device or a party that is authorized (e.g. licensed) by such OEM to provide the replaceable components. These trusted parties can be associated, for example, with a certain level of quality and with warranties running with the host device. In contrast, a liquid propelling component provided by a non-trusted or non-authorized party may sometimes produce less reliable results (e.g. low quality print, unreliable diagnosis), damage the host device, or affect a warranty that runs with the host device.

BRIEF DESCRIPTION OF THE DRAWINGS

For the purpose of illustration, certain examples constructed in accordance with this disclosure will now be described with reference to the accompanying drawings.

DETAILED DESCRIPTION

In the following detailed description, reference is made to the accompanying drawings. The examples in the description and drawings should be considered illustrative and are not intended as limiting to the specific example or element described. Multiple examples can be derived from the following description and drawings through modification, combination or variation of the different elements.

Figure 1:
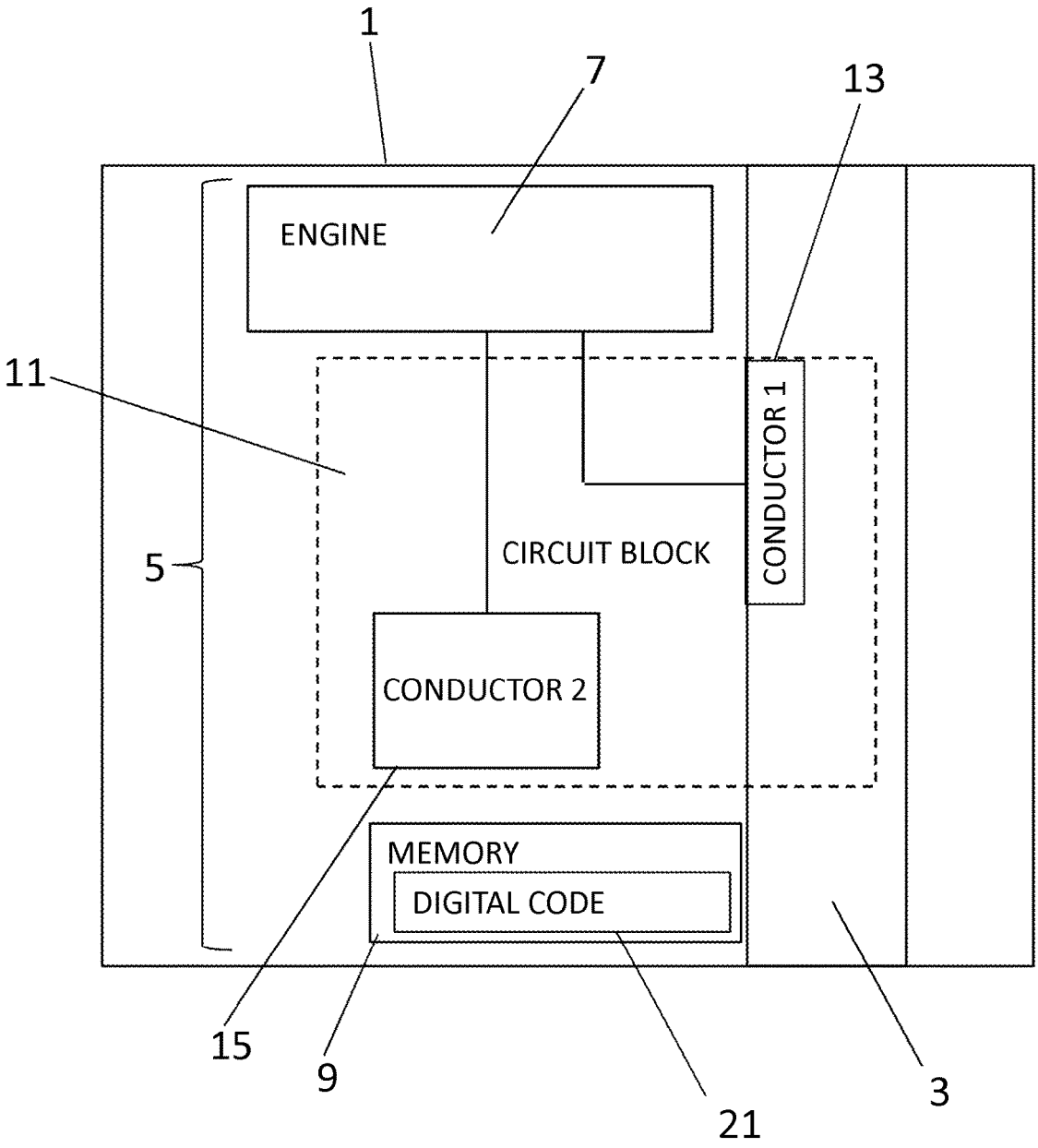
FIG. 1 illustrates a diagram of an example of a liquid propelling component.

FIG. 1 illustrates a diagram of an example of a liquid propelling component 1 that is to be connected to a host device and replaced after usage or exhaustion. The liquid propelling component 1 may be semi-conductor or MEMS (Micro-Electrical Mechanical System) device obtained by semi-conductor fabrication methods including photolithography and chemical treatments. The liquid propelling component 1 includes a liquid channel 3 through which liquid is propelled. The liquid channel 3 may be of microscopic or nanoscopic size, for example having a smallest width or diameter of between approximately 1-250 microns. In one example the liquid channel 3 terminates in a nozzle to expel the liquid.

The liquid propelling component 1 includes circuitry 5 to propel and/or analyze liquid in the component 1. The circuitry 5 includes actuators to propel the liquid. The actuators can be of microscopic or nanoscopic dimensions and may include thermal resistors, piezo resistors or micro-pumps. The circuitry 5 may further include sensing circuits to sense certain liquid properties. The circuitry 5 includes an engine 7 to drive the actuators and/or read the sensing circuits.

Components of the engine 7 may include a state machine, buffer amplifiers, sample and hold amplifiers, a digital to analog converter, an analog to digital converter and measurement circuitry. Functions of the engine 7 can include converting a digital input received from a host device to an analogue output to drive the actuators and the sensing circuits, and converting an analogue reading to a digital output for communicating sensed properties to the host device. The circuitry 5 further comprises a memory 9 that is non-volatile and non-transitory. The memory 9 may include a read-only memory. The engine 7 may include a register.

The circuitry 5 includes a first conductor 13 disposed in the liquid channel 3. The first conductor 13 can be disposed on a wall of the liquid channel 3. The first conductor 13 is to be in contact with liquid when liquid flows through the liquid channel 3. The first conductor 13 can be any type of resistor, plate, electrode, terminal or capacitor which electrical properties are influenced by contacting liquid. In certain examples, the first conductor 13 comprises tantalum. The first conductor 13 may comprise protective coating such as a passivation layer. The wall of the liquid channel 3 on which the first conductor 13 is disposed can be composed of at least one suitable dielectric material that may be used in semi-conductor fabrication, such as at least one of SU8, Silicon Oxide, Silicon Nitride, Silicon Carbide, TEOS, etc. In one example, the first conductor 13 is a terminal of a sensing circuit. In another example the first conductor 13 is at least part of a propelling device such as a thermal or piezo-resistor or micro-pump. In both examples, the engine 7 is to charge the first conductor 13 so that the first conductor 13 can execute its sensing or actuating function or both.

In an example the first conductor 13 is tested and calibrated during manufacturing to determine an appropriate charge for its sensing or actuating function. Once an appropriate charge of the first conductor 13 is determined, the charge can be stored in the memory 9.

The circuitry 5 includes a second conductor 15. The second conductor 15 can be a resistor, plate, terminal, capacitor or the like of a similar type as the first conductor 13. The second conductor 15 is insulated from liquid, such that its analogue electrical properties are not affected by the liquid. For example, the second conductor 15 is disposed in the MEMS structure at a distance from the liquid channel 3. In one example the second conductor 15 is surrounded by dielectric and/or ground material to avoid physical and electrical contact with the liquid. Suitable material that surrounds or abuts the second conductor 15 may include suitable dielectric silicon such as SU8, Silicon Oxide, Silicon Nitride, Silicon Carbide, TEOS, etc., and/or suitable ground material such as polysilicon or aluminum. In one example, the second conductor 15 includes polysilicon.

The circuitry 5 includes a circuit block 11 of the first and second conductor 13, 15. The circuit block 11 is controlled by the engine 7. The circuit block 11 has a dedicated function, such as sensing or actuating. The circuit block 11 may be part of the same layer of the MEMS structure. In an example, the first and second conductors 13, 15 are manufactured in the same fabrication steps, and have the same properties. In another example, the first and second conductors 13, 15 are composed of substantially the same materials. The engine 7 may charge and read the conductors 13, 15 in a similar manner.

During fabrication, the first and second conductor 13, 15 can be tested and calibrated. Accordingly appropriate charge ("bias" or "pre-charge") values are determined for the conductors 13, 15 at a fabrication calibration stage. In one example it is intended that the engine 7 charges each conductor 13, 15 according to the determined charge value during the operational lifetime of the liquid propelling component 1. In one example, one charge value is used for both conductors 13, 15. For example, one charge value applies to the entire circuit block 11. In another example, separate charge values are used for the first and second conductor 13, 15. During calibration, the charge value is optimized so as to have an effective charging of the respective conductor 13, 15.

The first and second conductors 13, 15 each have certain analogue characteristics which are subject to manufacturing tolerances and inherently different than their manufacturer specified nominal characteristics. These analogue characteristics are not exactly known before fabrication. Example analogue characteristics include impedance and resistance. Other measureable example analogue characteristics include time-based residual charge, phase angle and inductance. The engine 7 is to read these analogue characteristics by measuring how the respective conductor 13, 15 reacts to the pre-determined charge, i.e. the charge that was determined during calibration.

When applying the predetermined charge to the first conductor 13, a returned analogue value varies depending on the presence or state of the liquid in contact with the first conductor 13. The first conductor 13 may return a different analogue value in operation, when typically liquid (or debris) is in contact with the first conductor 13, then during fabrication, when typically liquid is absent. In contrast, the second conductor 15 is insulated form liquid during operation. Hence, an analogue value of the second conductor 15 can be returned at a fabrication calibration stage, when no liquid present in channels, and that value should be relatively similar during operation, when liquid is present in the channels 3.

During fabrication, the analogue value of the second conductor 15 may be measured by inducing a pre-determined charge. The measured analogue value is converted to a digital code 21 by the engine 7. The digital code 21 is encoded in the memory 9, for example in an encrypted manner in a non-rewritable memory such as a ROM (Read-Only Memory). At a later stage, in an installed and operational condition of the liquid propelling component 1, the analogue value may be again measured and converted to a second digital code by the same engine 7 using the same charge value, and communicated to a host device to allow comparison of the newly measured digital code with the previously encoded digital code 21.

In one example, if the previously encoded digital code and the newly measured digital code of the second conductor 15 match, the liquid propelling component 1 has been properly fabricated and calibrated. In another example, if said digital codes match, then it is likely that these were encoded by an authorized manufacturer. In contrast, if it is determined that the previously encoded and newly measured digital codes do not match, then there is a high probability that the fabrication of the liquid propelling component 1 was not authorized by an OEM of the host device. Also for other reasons, a matching of previously encoded and newly determined digital codes may be used for authentication purposes.

As already explained, an analogue value of the second conductor 15 will be different for each liquid propelling component 1. Such analogue value can be used as an inherently present, unique identification code, like a finger print or serial number. For identification purposes, the second conductor 15 is more suitable than the first conductor 13 because the first conductor 13 is typically in contact with liquid during operation. Hence, the measured analogue electrical characteristics are different depending on the presence or state of the liquid. Therefore a second conductor 15 is included in the same circuit block 11 and used for identification purposes. In an example that will be explained with reference to FIG. 3, a liquid propelling component includes a plurality of circuit blocks, each having at least one second conductor, to store a unique digital authentication code of multiple unique analogue values.

Figure 2:
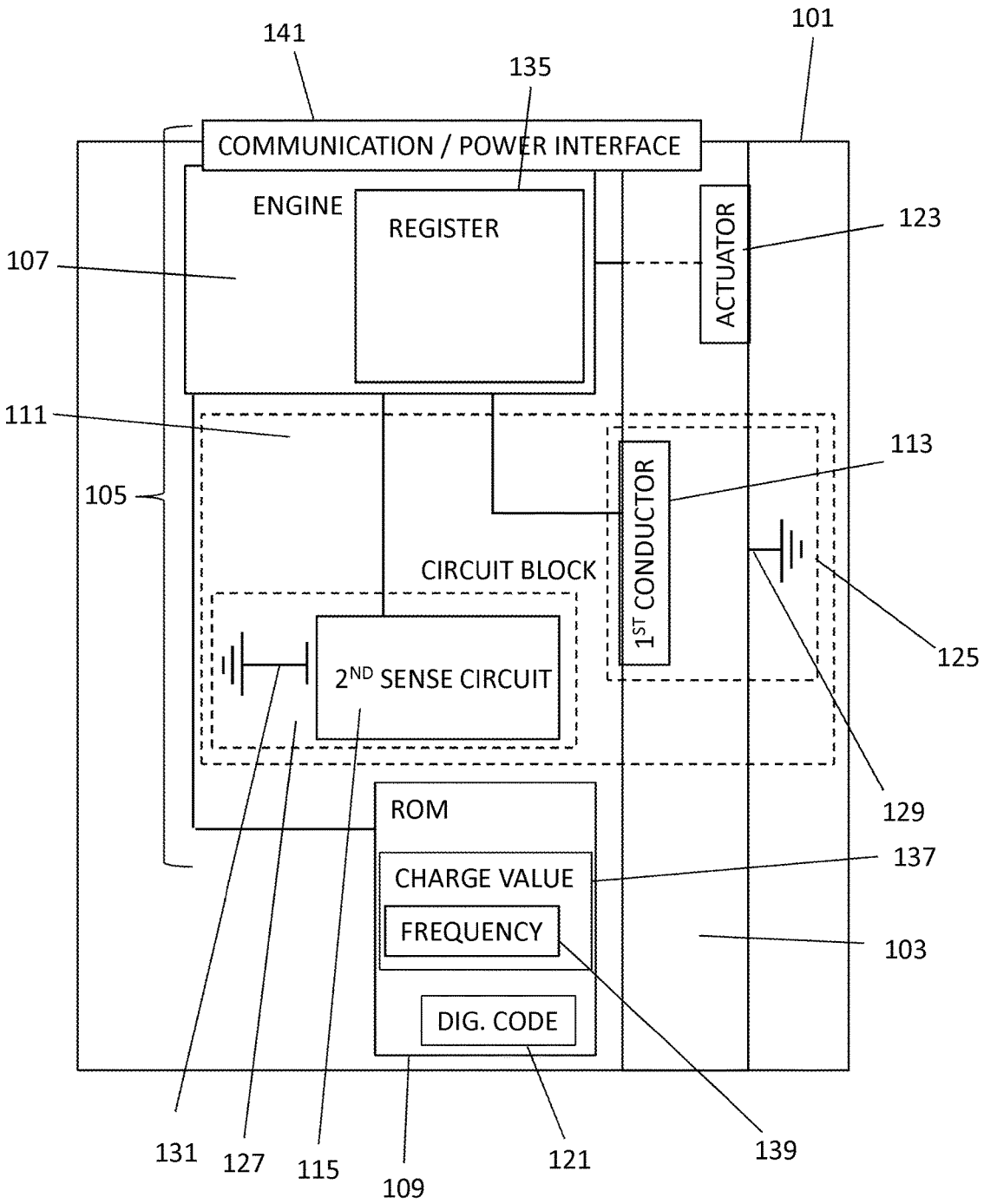
FIG. 2 illustrates a diagram of another example of a liquid propelling component.

FIG. 2 illustrates a second example of a liquid propelling component 101. The liquid propelling component 101 includes a liquid channel 103 of microscopic or nanoscopic dimensions. The liquid channel 103 may include at least one of an elongate liquid channel, a chamber and a nozzle. The liquid propelling component 101 includes semi-conductor circuitry 105. In one example, the semi-conductor circuitry 105 includes or forms part of a MEMS structure that includes semi-conductor components, liquid channels, etc. The circuitry 105 includes a liquid actuator 123 to propel the liquid in the channel 103, for example out of a nozzle. The actuator 123 can be one of a thermal resistor actuator, a piezo resistor actuator or any type of micropump. Example actuators 123 are thermal inkjet resistors and piezo inkjet resistors.

The circuitry 105 further includes a sensing circuit block 111. The circuit block 111 includes a first sensing circuit 125 and a second sensing circuit 127. In different application examples each of the first and second sensing circuit 125, 127 may function as impedance sensors, resistance sensors or sensors of other analogue electrical characteristics such as time-based residual charge, phase angles or inductance. The first sensing circuit 125 includes a first conductor 113 that extends in the liquid channel 103 to contact liquid. The first conductor 113 functions as a first terminal of the first sensing circuit 125. The first conductor 113 may be plate shaped. The first sensing circuit 125 further includes a ground 129. The ground 129 may serve as a second terminal of the sensing circuit 125. The ground 129 may be formed by a portion of the liquid channel wall, for example a p-doped channel wall portion that is connected to a ground output of a communication/power interface 141. In one example, the first conductor 113, liquid (and/or air and/or debris) and p-doped silicon wall act as a capacitor. The engine 7 and first sensing circuit 125 are calibrated to sense a liquid presence or absence or other states of the liquid (dryness, debris) between the terminals 113, 129. During this calibration, an appropriate charge value for the first sensing circuit 125 is determined and stored.

The second sensing circuit 127 includes a second conductor 115. The second conductor 115 is insulated from liquid. Near the second conductor 115 a second ground 131 is provided, also insulated from liquid. The second conductor 115 and the second ground 131 form terminals of the second sensing circuit 127. Analogue values sensed through the second sensing circuit 127 may be substantially independent of a presence or state of liquid. The second ground 131 may be disposed at a suitable distance from the second conductor 115. In one example, the second ground 131 is to connect to a ground of a host device, in an installed condition of the liquid propelling component 101. In one example, the second conductor 115 is a reference plate and includes polysilicon, wherein the polysilicon is disposed on a thermal oxide layer which is disposed on a layer of n-active silicon material which in operation is connected to a ground of the host device. In another example, the second ground 131 is connected to a p-doped wafer portion.

The circuitry 105 includes an engine 107 to instruct the actuators 123 and sensing circuit block 111 and to convert sensed analogue values to digital codes for processing by a host device. The circuitry 105 further includes a ROM 109 that stores a digital code corresponding to an analogue value of at least the second sensing circuit 127. The ROM 109 is to be read by the host device. In different examples, the engine 107 includes a digital to analogue converter, an analogue to digital converter, an input sample and hold (S & H) element, a switch, an output S & H element, a state machine, a clock and a number of registers. The engine 107 can be connected to a voltage source of a host device. The engine 107 is to induce a current to the sensing circuits 125, 127. Appropriate charge values 137 for the sensing circuits 125, 127 are determined at fabrications stage and encoded in the ROM 109, to be read by the host device, and then instructed to the engine 107.

The engine 107 is to induce the first and second sensing circuits 125, 127 with the charge(s) stored in the ROM 109. In one example, a charge value 137 of the first sensing circuit 125 is determined during calibration, wherein the charge value 137 is optimized to distinguish between impedances in a dry and in a wet state of the first conductor 113. The charge value 137 may include a suitable frequency 139 to charge the first conductor 113. In one example a clock mechanism is used to adapt a sensor control signal of the engine to a suitable frequency. The engine 107 further includes at least one register 135, or a suitable read-write memory to temporarily store the charge values during operation. In an example system, a host device reads the charge values from the ROM 109 and sets certain bits of the engine register 135 to these charge values, in order for the engine 107 to induce the sensing circuits 125, 127 with these charges.

In one example the ROM 109 stores the same charge value 137 for both the first and second sensing circuit 125, 127. For example the engine 107 may induce the same charge to both sensing circuits 125, 127 in the circuit block 111. Hence, the engine 107 may use the same register bit location for charging both sensing circuits 125, 127 of the circuit block 111. In yet another example, the first and second sensing circuit 125, 127 are to use different charge values 137 that are separately stored in the ROM 109, where the engine 107 is configured to read different bit locations in the register 135 to apply correspondingly different charges to each sensing circuit 125, 127.

The ROM 109 stores a digital code 121 corresponding to the second sensing circuit 127. The digital code 121 corresponds to an analogue value of the second sensing circuit. The digital code 121 may be encoded on the ROM 109 as a locked or encrypted dataset, for unlocking or decryption by a host device. In one example the digital code 121 covers a range of analogue values for the second sensing circuit 127. The digital code 121 may be set in accordance with a limited set of pre-fixed digital codes that each correspond to a certain range of analogue values. Different ranges of analogue values may overlap to allow for some margin when a measured analogue value is near a border of a range. In another example the digital code on the ROM 109 corresponds to a specific analogue value wherein predetermined margins are applied by the host device to allow for matching of pre-stored and newly read digital codes.

The liquid propelling component 101 includes a communication/power interface 141 to communicate with a host device. The communication/power interface 141 is connected to the rest of the circuitry 105. At least one of a data connection, voltage source connection and ground source connection can be established through such communication/power interface 141. In one example, the communication/power interface 141 includes an array of contact pads.

In certain examples, the liquid propelling component 101 includes a plurality of circuit blocks 111, similar to the example described with reference to FIG. 3 below.

Figure 3:
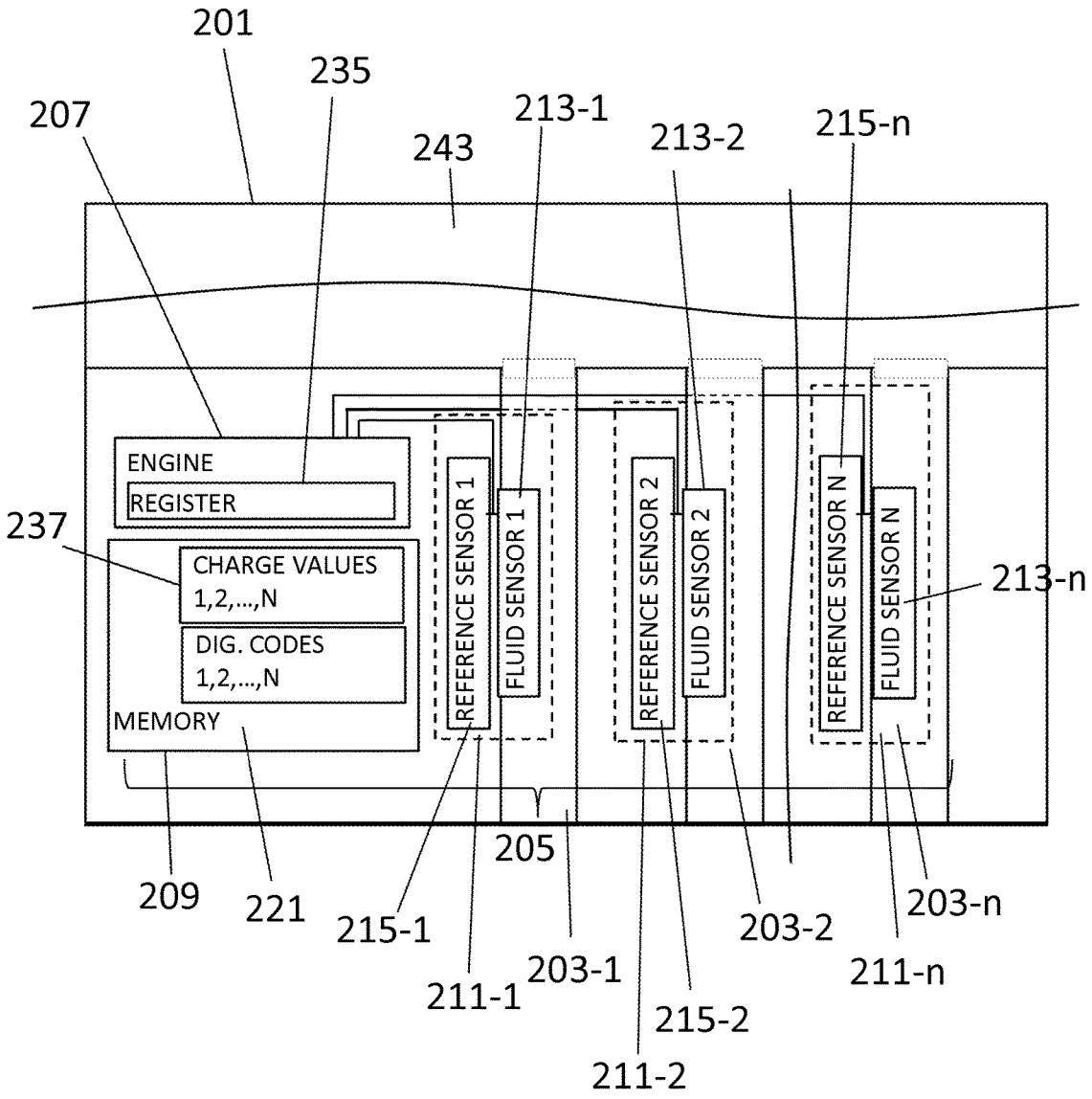
FIG. 3 illustrates a diagram of yet another example of a liquid propelling component.

FIG. 3 illustrates another example of a diagram of a liquid propelling component 201. The liquid propelling component 201 includes MEMS circuitry 205. The MEMS circuitry 205 includes a plurality of liquid channels 203-1, 203-2, **203-*n*. In the illustrated example the liquid channels 203-1, 203-2, 203-*n* receive liquid from at least one liquid source 243 such as a reservoir. The liquid source 243 may be an integral part of the liquid propelling component 201. Liquid is propelled through the channels 203-1, 203-2, 203-*n*** by actuators in the channels, not illustrated in this example. The actuators may be thermal or piezo resistors or any other suitable micro-pump mechanism. In one example the liquid comprises ink. In a further example the liquid propelling component is an integrated printhead cartridge for an inkjet printer.

The MEMS circuitry 205 further includes a plurality of impedance sensing circuit blocks 211-1, 211-2, **211-*n*. In this example, one impedance sensing circuit block 211-1, 211-2, 211-*n* is associated with one respective liquid channel 203-1, 203-2, 203-*n*. In other examples, one impedance sensing circuit block 211-1, 211-2, 211-*n* is associated with an array of liquid channels, or vice versa, one liquid channel 203-1, 203-2, 203-*n* may be associated with an array of impedance sensing circuit blocks 211-1, 211-2, 211-*n***.

In this example, each impedance sensing circuit block 211-1, 211-2, **211-*n* includes a fluid impedance sensor 213-1, 213-2, 213-*n* that is to be in contact with liquid when liquid flows through the liquid channel 203-1, 203-2, 203-*n*. Each fluid impedance sensor 213-1, 213-2, 213-*n* includes two terminals that are to be in contact with liquid, for example a conductor terminal and a ground terminal, that together with the liquid are to form a capacitor. Furthermore, each impedance sensing circuit block 211-1, 211-2, 211-*n* includes a reference impedance sensor 215-1, 215-2, 215-*n* that is insulated from the liquid. Each reference sensor 215-1, 215-2, 215-*n* includes two terminals, for example a conductor terminal and a ground terminal. In an example, the reference sensor 215-1, 215-2, 215-*n* is used as a reference to enable for trouble shooting of each circuit block 211-1, 211-2, 211-*n***.

The MEMS circuitry 205 includes an engine 207 to control a charge over the impedance sensors 213-1, 213-2, **213-*n*, 215-1, 215-2, 215-*n*. A charge value 237-1, 237-2, 237-*n* for each impedance sensor 213-1, 213-2, 213-*n*, 215-1, 215-2, 215-*n* is stored in a table in a ROM 209. The charge value may include a certain frequency 237-1, 237-2, 237-*n*. The engine 207 charges each impedance sensor 213-1, 213-2, 213-*n*, 215-1, 215-2, 215-*n* using the corresponding pre-stored charge values 237-1, 237-2, 237-*n*. In operation, the charge values 237-1, 237-2, 237-*n* may be read by a host device and written on the register 135 to charge respective sensors 213-1, 213-2, 213-*n*, 215-1, 215-2, 215-*n*. As described above, each of the charge values 237-1, 237-2, 237-*n* may have been determined at a calibration stage of the respective sensor 213-1, 213-2, 213-*n*, 215-1, 215-2, 215-*n*. In one example, the charge value 237-1, 237-2, 237-*n* of each fluid impedance sensors 213-1, 213-2, 213-*n* has been calibrated to distinguish between (i) wet, (ii) dry or (iii) other (e.g. dry, contaminated) conditions of the sensor 213-1, 213-2, 213-*n*. In one example, the charge values 237-1, 237-2, 237-*n* used for the fluid impedance sensors 213-, 213-2, 213-*n* are also used for the reference impedance sensors 215-1, 215-2, 215-*n* or the entire circuit block 211-1, 211-2, 211-*n*. In other examples the pre-stored charge values 237-1, 237-2, 237-*n* for the fluid impedance sensors 213-1, 213-2, 213-*n* and the pre-stored charge values for the reference impedance sensors 215-1, 215-2, 215-*n* are different, for example because optimum charge values 237-1, 237-2, 237-*n* for the fluid impedance sensor 213-1, 213-2, 213-*n* and the reference impedance sensor 215-1, 215-2, 215-*n*** are different.

In addition to the charge values 237-1, 237-2, **237-*n*, the ROM 209 stores digital codes 221-1, 221-2, 221-*n* that correspond to impedance readings of the reference impedance sensors 215-1, 215-2, 215-*n* of these charge values 237-1, 237-2, 237-*n*. For example, the reference impedance sensors 215-1, 215-2, 215-*n* are charged using the earlier mentioned optimized stored charge values 237-1, 237-2, 237-*n*, whereby the resulting analogue impedance values are measured and converted to digital codes 221-1, 221-2, 221-*n* by the engine 207. At a later operational stage of the liquid propelling component 1 the impedance of the reference impedance sensors 215-1, 215-2, 215-*n* can be again measured by the engine 7**, and resulting digital values can be compared with the stored digital codes by a host device.

Figure 4:
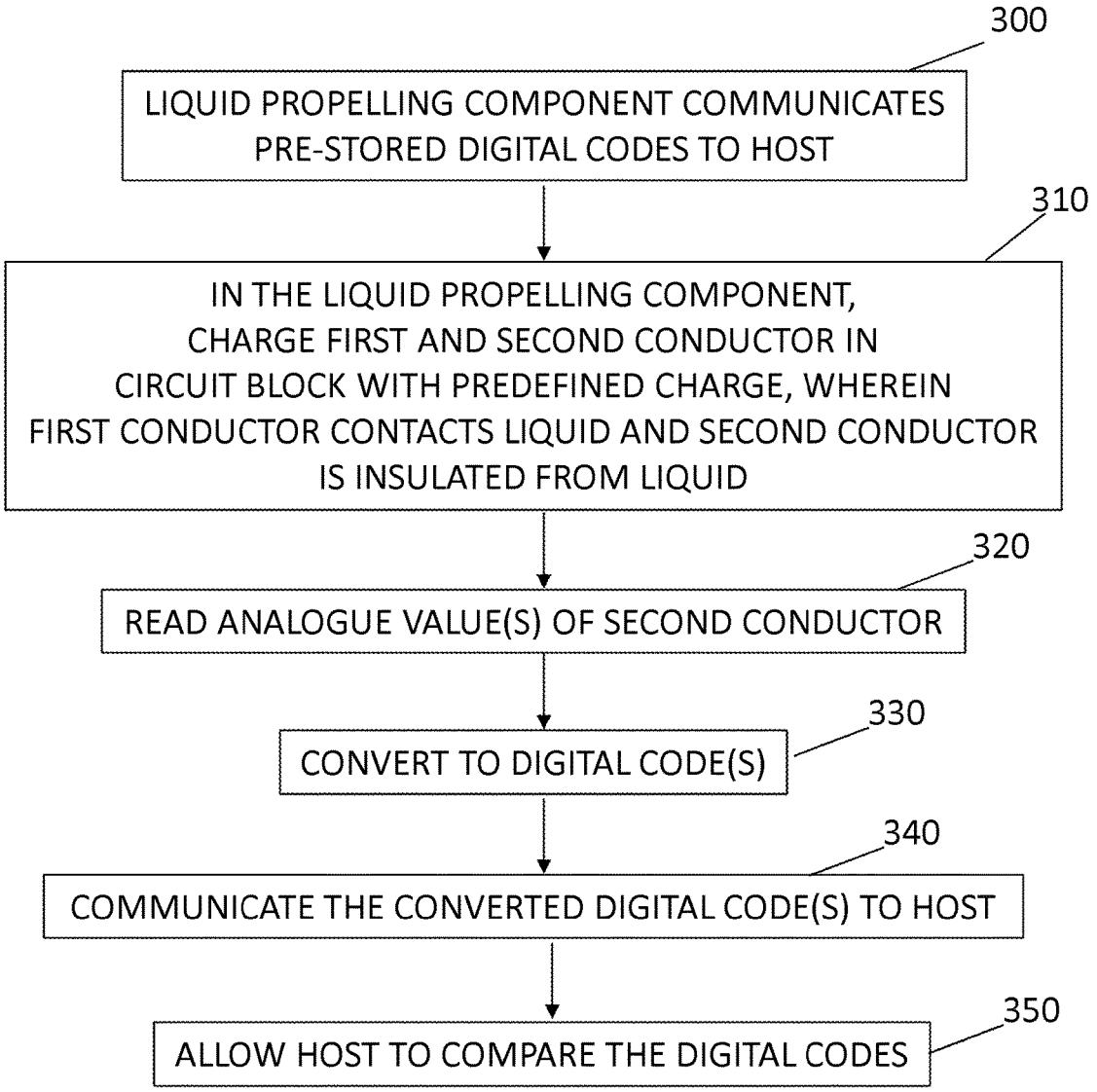
FIG. 4 illustrates a flow chart of an example of a method of reading and communicating analogue values in and from a liquid propelling component.

FIG. 4 illustrates an example flow chart of a method of communicating values in a liquid propelling component. The method includes the liquid propelling component communicating at least one pre-stored digital code to a host device (block 300). In an example, this is triggered by installing the liquid propelling component in the host device. The method further includes charging, in the liquid propelling component, a first and second conductor in a common circuit block with a predefined charge, wherein the first conductor contacts liquid and the second conductor is insulated from liquid (block 310). The method further includes reading analogue values of the second conductor (block 320). The method includes converting these analogue values to digital codes (block 330). The method further includes communicating the converted digital codes to the host device (block 340). The method further includes facilitating a host device to compare the newly read converted digital codes to the pre-stored digital codes (block 350), for example in order to authenticate the liquid propelling component.

Figure 5:
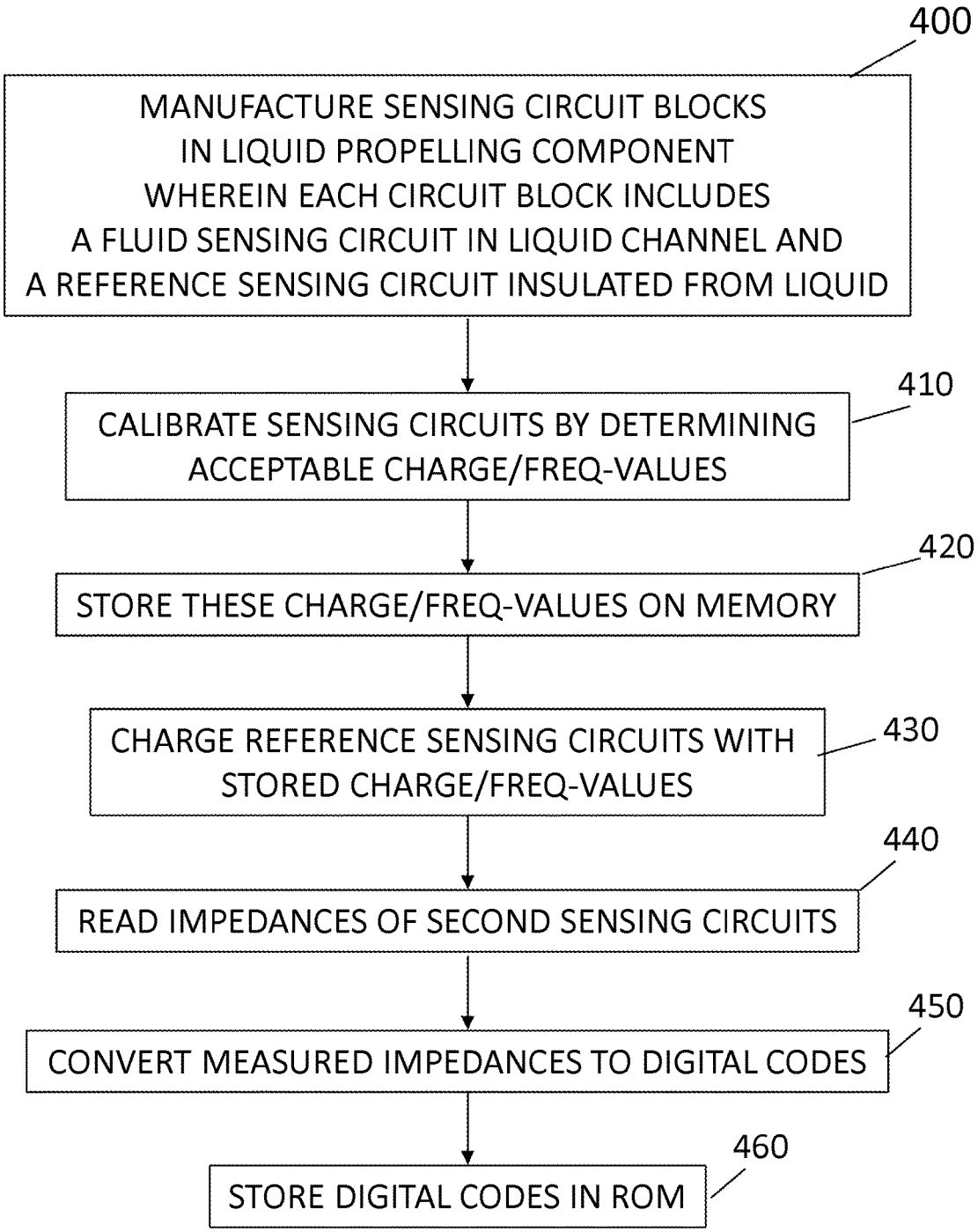
FIG. 5 illustrates a flow chart of an example of a method of manufacturing a liquid propelling component.

FIG. 5 illustrates a flowchart of an example of a method of manufacturing a liquid propelling component. The method includes manufacturing sensing circuit blocks in a liquid propelling component, wherein each circuit block includes a fluid impedance sensing circuit in a liquid channel and a reference impedance sensing circuit insulated from liquid (block 400). The method includes calibrating each sensing circuit to determine appropriate charge values for each sensing circuit (block 410). For example a charge value of the fluid impedance sensing circuit is optimized to reliably determine a presence, absence or state of liquid in a liquid channel. In one example only the fluid impedance sensing circuit is calibrated and the determined charge value is used for both the fluid impedance sensing circuit and the reference impedance sensing circuit. The charge value may include a frequency value. The method further includes storing the determined charge values in a memory such as a ROM of the liquid propelling component (block 420). The method further includes charging the reference impedance sensing circuits using the stored charge values (430). The method further includes reading impedances of the reference impedance sensing circuits (440). The method includes converting these measured impedances to digital codes (block 450), for example using an analogue-to-digital converter. The method further includes storing these digital codes on the memory such as a ROM of the liquid propelling component (block 460).

The example method of FIG. 5 may allow for reading the impedances of the reference impedance sensing circuits after installing the liquid propelling component, converting these impedances to digital codes, and comparing these digital codes with pre-stored digital codes, whereby the liquid propelling component can be authenticated if converted and pre-stored digital codes match, using appropriate error margins or conversion algorithms. In one example, the digital codes stored on the memory represent a certain bandwidth of analogue values so as to include a certain error margin. In another example the digital code corresponds to relatively specific measured analogue value whereby a certain error margin is included in a comparison algorithm that is executed by a host device. In a further example, a plurality of digital codes may be encoded to the memory as a single code, for example using a suitable encryption and/or compression algorithm.

Instead of impedance, other analogue values such as resistance may be measured. Instead of impedance sensors other types of sensors or other devices could be used, such as for example thermal or piezo resistors or sensing resistors, wherein reference resistors may be added to each circuit block. According to some of the above described principles, such other devices are provided with a first conductor that is to contact the liquid and a second conductor of the same circuit block that remains unaffected by liquid that may be used for reference purposes.

In an example, the liquid propelling component includes a liquid dispense head, such as a printhead, for ejecting liquid out of nozzles, wherein each fluid channel my open into at least one nozzle. In an example of a liquid dispense head, one liquid sensing circuit is provided near each nozzle, or pair or group of nozzles. For example, the liquid sensing circuit is disposed in a fluid channel near a nozzle, and/or near a firing chamber to sense presence or absence of liquid near a firing chamber or to sense clogging.

In one example, a liquid channel of one of the described examples has a diameter of approximately 1-250 micron. For example, the liquid channel includes a firing chamber and a nozzle. Such firing chamber can have a height, width and length dimension that are each between approximately 1 micron and 100 micron. An example volumetric dimension of a firing chamber is 32×54×21 micron. A nozzle can have a diameter of approximately 5-70 microns, for example 30-60 microns, for example approximately 46 micron. Channels that lead up to a firing chamber or nozzle or that extend between the firing chamber and nozzle may have a smallest width ("pinch point") of between approximately 1 and 20 microns, for example 10 or 7 or 5 microns. Different dimensions may apply. Example impedance sensors can be disposed in these channels, for example near a respective firing chamber o nozzle.

What is claimed is:

1. A liquid propelling component, comprising an array of liquid channels to guide liquid;

circuitry to at least one of propel and analyze liquid, the circuitry comprising:

a corresponding array of sensing circuit blocks comprising first and second terminals, the first terminal disposed in at least one of the liquid channels of the array to be in contact with liquid in the at least one liquid channel and a second terminal insulated from liquid in the at least one liquid channel;

an engine to charge the terminals according to a predefined charge value and read an analogue value of at least the second terminal; and a memory storing a digital code that corresponds to the analogue value of the second conductor under the predefined charge.

2. The liquid propelling component of claim 1, the memory further storing the predefined charge value.

3. The liquid propelling component of claim 1, wherein:

the engine is further to:

read the analogue values of both conductors; and convert the analogue values to corresponding digital values; and the circuitry further includes at least one communication interface, the communication interface to communicate the digital values to a host device.

4. The liquid propelling component of claim 1, wherein the engine is to charge both conductors of the circuit block according to the same charge value.

5. The liquid propelling component of claim 1, wherein the corresponding array of sensing circuit blocks include impedance sensing circuits and the analogue value is impedance.

6. The liquid propelling component of claim 1, wherein the corresponding array of sensing circuit blocks each include ground terminals.

7. The liquid propelling component of claim 1, comprising, separate from the circuit blocks, liquid propelling resistors to propel the liquid.

8. A liquid propelling component, comprising a plurality of liquid channels;

a plurality of circuit blocks, each block including:

a liquid sensing circuit comprising a first conductor n a liquid channel to contact liquid; and a reference sensing circuit comprising a second conductor insulated from the liquid;

a read-only memory storing:

charge values for charging each of the second conductors; and a plurality of digital codes corresponding to analogue values of the second conductors when induced according to said charge values; and an engine to:

charge the conductors using the stored charge values;

read analogue values of the conductors of each circuit block; and convert the analogue values to digital codes.

9. The liquid propelling component of claim 8, wherein each sensing circuit includes a ground to allow impedance sensing between the respective conductor and the ground.

10. The liquid propelling component of claim 8, comprising, separate from the circuit blocks, liquid propelling resistors to propel the liquid.

11. The liquid propelling component of claim 8, comprising:

at least one of a communication interface and a power interface, and a liquid source to supply liquid to the liquid channels, wherein the liquid propelling component is a replaceable cartridge for connection to a host device.

12. The liquid propelling component of claim 11, wherein:

the liquid propelling component is an integrated printhead inkjet cartridge for connection to a host device; and the liquid source comprises ink.

13. A liquid propelling component, comprising:

a liquid channel to guide liquid;

circuitry comprising:

a sensing circuit block comprising a first terminal disposed in the liquid channel to be in contact with liquid in the liquid channel and a second terminal insulated from liquid in the liquid channel;

an engine to:

charge the first terminal and the second terminal according to a predefined charge value; and read an analogue value of the second terminal; and a memory storing a digital code that corresponds to the analogue value of the second terminal under the predefined charge.

14. The liquid propelling component of claim 13, comprising:

an array of liquid channels; and a corresponding array of first and second conductors, wherein the first and second conductors are terminals of sensing circuits.

15. The liquid propelling component of claim 14, wherein each sensing circuit includes a ground to allow impedance sensing between the respective conductor and the ground.

16. The liquid propelling component of claim 13, wherein:

the first conductor is part of a liquid sensing circuit; and the second conductor is part of a reference sensing circuit.

17. The liquid propelling component of claim 13, comprising:

liquid propelling resistors that propel liquid separate from the circuit blocks.

18. The liquid propelling component of claim 13, comprising:

at least one of a communication interface and a power interface, and a liquid source to supply liquid to the liquid channels, wherein the liquid propelling component is a replaceable cartridge for connection to a host device.

19. The liquid propelling component of claim 13, wherein the memory is a read-only memory and the engine comprises a register to store the charge value in operation.

* * * * *